United States Patent [19]

Akutsu et al.

[11] Patent Number: 4,546,780

[45] Date of Patent: Oct. 15, 1985

[54] APPARATUS FOR AIR DRYING TOBACCO LEAVES

[76] Inventors: Takao Akutsu; Kiyomi Sato, both of 1-31, Kurobegaoka, Hiratsuka-shi, 254, Japan

[21] Appl. No.: 536,499

[22] Filed: Sep. 28, 1983

[30] Foreign Application Priority Data

Oct. 25, 1982 [JP] Japan ..... 57-185953

[51] Int. Cl.[4] ..... A24B 3/10

[52] U.S. Cl. ..... 131/304; 131/302; 131/306

[58] Field of Search ..... 131/302, 304, 306

[56] References Cited

U.S. PATENT DOCUMENTS 1,551,676 9/1925 McConnell ..... 131/304
3,399,462 9/1968 Koch et al. ..... 131/304
3,482,328 12/1969 Larkham ..... 131/304
4,177,576 12/1979 Psaras ..... 131/304
4,452,256 6/1984 Wochnowski et al. ..... 131/304

FOREIGN PATENT DOCUMENTS 0563724 6/1960 Belgium ..... 131/304

*Primary Examiner*—Vincent Millin

[57] ABSTRACT

An apparatus for air drying tobacco leaves is provided. The apparatus comprises a vertical hopper section disposed beneath the discharge end of a tobacco leaf supply conveyor, an air-permeable conveyor to transport supplied tobacco leaves oriented in parallel to a direction of air flow, a drying chamber provided to cover the air-permeable conveyor, drying air circulating means, tobacco leaf layer level sensors, and means for controlling the rate of supply of tobacco leaves according to the signals provided from said sensors. The apparatus can obtain a good drying efficiency for air drying tobacco leaves.

6 Claims, 5 Drawing Figures

APPARATUS FOR AIR DRYING TOBACCO LEAVES

BACKGROUND OF THE INVENTION

This invention relates to improvements in the air-permeable conveyor apparatus for drying tobacco leaves free from stems (hereinafter referred to as tobacco leaves).

As usual air permeable conveyor type apparatus for drying tobacco leaves has a box-like drying chamber, through which a horizontally disposed air-permeable conveyor extends such that it is covered except for its inlet and outlet section. As tobacco leaves are conveyed on the upper run of the air-permeable conveyor, they are dried continuously by drying air circulated across the air-permeable conveyor upper run and the tobacco leaves conveyed thereby.

Tobacco leaves to be dried are supplied to the drying apparatus usually by means of a conveyor. In this case, tobacco leaves are transferred onto and conveyed on the air-permeable conveyor in an orientation parallel to the plane of the air-permeable conveyor, i.e., perpendicular to the direction of supply of drying air. Therefore, the drying air passes through the layer of tobacco leaves along complicated paths and thus encounters great resistance. The resistance offered to the flow of air is not uniform and, therefore, air passes through paths where the resistance against the flow is less, thus resulting in a lack of uniformity of drying. In addition, the overall drying efficiency is inferior.

SUMMARY OF THE INVENTION

The present invention seeks to overcome the drawbacks discussed above in the prior art. An object of the invention is to provide an apparatus which can increase the area of tobacco leaves exposed to dry air for reducing the installation space of the apparatus.

Another object of the invention is to provide an apparatus which can obtain a good drying efficiency for air drying tobacco leaves through shortening the drying time.

A further object of the invention is to provide an apparatus which can reduce power consumed by the motor for driving the air circulation fans and also reduce the drying air circulation fans.

A still further object of the invention is to provide an apparatus which can reduce the scattering of tobacco leaves.

DETAILED DESCRIPTION OF THE EMBODIMENTS

Now, an embodiment of the invention will be described with reference to the drawings.

Figure 1:
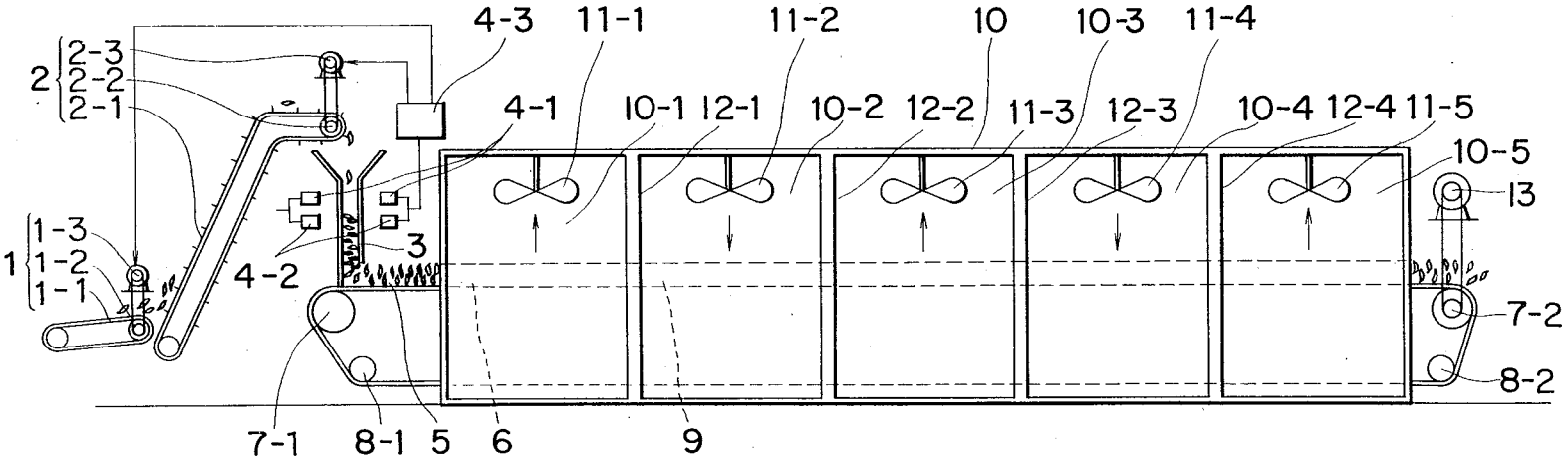
FIG. 1 is a sectional view showing an air-permeable conveyor type drying apparatus for air drying tobacco leaves.

FIG. 1 is a sectional view showing an air-permeable conveyor type drying apparatus for drying tobacco leaves. The apparatus includes tobacco leaf supply conveyor sections 1 and 2. The conveyor section 1 includes a horizontal conveyor 1-1, and the conveyor section 2 includes an inclined conveyor 2-1. The conveyor section 1 further includes a pulley 1-2 and a drive motor 1-3. The conveyor section 2 further includes a pulley 2-2 and a drive motor 2-3.

Figure 2:
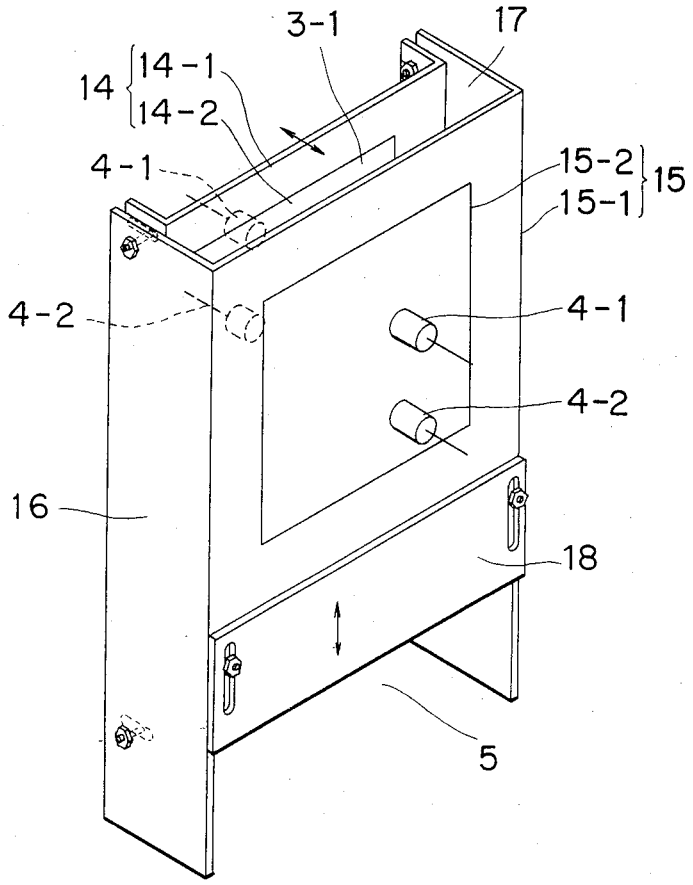
FIG. 2 is a schematic perspective view showing a hopper section.

A hopper section 3 having a vertical path is disposed beneath the upper discharge end of the conveyor section 2. FIG. 2 shows a schematic perspective view of the vertical path, i.e., guide portion of the hopper section 3. As is shown, the guide portion of the hopper section 3 has first to fourth walls 14 to 17. The first wall 14 extends upright and at right angles to the direction of transport of an air-permeable conveyor 6 to be described later in detail. The second wall 14 extends parallel to the first wall 14 and spaced apart therefrom by 5 to 15 cm. The third and fourth walls 16 and 17 are provided on the opposite sides of the first and second walls 14 and 15. The first wall 14 is slidable in a space between the third and fourth walls 16 and 17. The length or vertical dimension of the second wall 15 is smaller than that of the first, third and fourth walls 14, 16 and 17. An outlet 5 of the hopper section 3 is defined under the second wall 15. The height dimension of the outlet 5 is manually adjustable by height adjustment member 18 provided for vertical movement on a lower portion of the second wall 15 through slot-and-fastening arrangement as depicted.

The first and second walls 14 and 15 have respective transparent members 14-2 and 15-2 fitted in their central portions. Upper and lower photosensors 4-1 and 4-2 are provided such that they face the transparent members 14-2 and 15-2. They serve to detect the level of tobacco leaves in the hopper section 3. The upper photosensor 4-1 is disposed below the discharge end of the conveyor section 2 and spaced apart therefrom at least by 30 cm. The lower photosensor 4-2 is disposed above the air-permeable conveyor 6 and spaced apart therefrom at least by 40 cm. The driving of the motor 1-3 for driving the horizontal conveyor 1-1 and the motor 2-3 for driving the inclined conveyor 2-1 is controlled by a controller 4-3 such that the level of tobacco leaves in the hopper section 3 is found between the upper and lower photosensors 4-1 and 4-2.

The air-permeable conveyor 6 runs in the close proximity of the first wall 14 and third and fourth walls 16 and 17. Said conveyor 6 is driven from motor 13, passed round pulleys 7-1 and 7-2 and guide rollers 8-1 and 8-2, and is usually made from a perforated steel sheet or a metal net. A row of drying chambers 10 are provided side by side such as to cover the air-permeable conveyor 6 except for an inlet and outlet section thereof. Partition members 12-1 to 12-4 define adjacent ones of the individual drying chambers 10-1 to 10-5. Air is supplied to the individual drying chambers 10-1 to 10-5 across the air-permeable conveyor 6 through air ducts (not shown). Fans 11-1 to 11-5 are disposed in the respective drying chambers. They are driven from a motor (not shown) provided outside the row of drying chambers.

While in the instant embodiment the first wall 14 is made movable between the stationary third and fourth wall 16,17 and toward and away from the stationary second walls 15 as depicted by an arrow in FIG. 2, it is also possible to make the first wall 14 stationary and make the second to fourth walls 15 to 17 movable toward and away from the first wall 14. Said movable wall, the first wall 14 or the second wall 15 is made manually movable. In either case, the first wall 14 and the third and fourth walls 16, 17 are connected to each other through slot-and-fastening arrangement as depicted.

In operation, a predetermined amount of tobacco leaves is stored in the conveyor sections 1 and 2 and then charged from the discharge end of the inclined conveyor 2 into the hopper section 3. The falling tobacco leaves are stacked in the vertical path, i.e., guide portion of the hopper section 3 in an orientation perpendicular to the direction of the fall, i.e., parallel to the surface of the air-permeable conveyor 6. The level of the stacked tobacco leaves in the hopper section 3 is held substantially constant by starting the conveyor sections 1 and 2 when the lower photosensor 4-2 detects passage of light and by stopping the conveyor sections 1 and 2 when the upper photosensor 4-2 detects interruption of light. As the stacked tobacco leaves are transferred from the hopper section 3 through the guide portion of the section 3 onto the air-permeable conveyor 6, their orientation is changed by 90° due to their own weight and the movement of the air-permeable conveyor 6. The tobacco leaves are thus conveyed on the air-permeable conveyor 6 in an orientation parallel to the flow of air supply. As the layer 9 of tobacco leaves conveyed on the air-permeable conveyor 6 through the successive drying chamber of the row of chambers 10, the tobacco leaves are dried by air circulated across the layer 9 either downwards or upwards by the fans 11-1 to 11-5.

Figure 3:
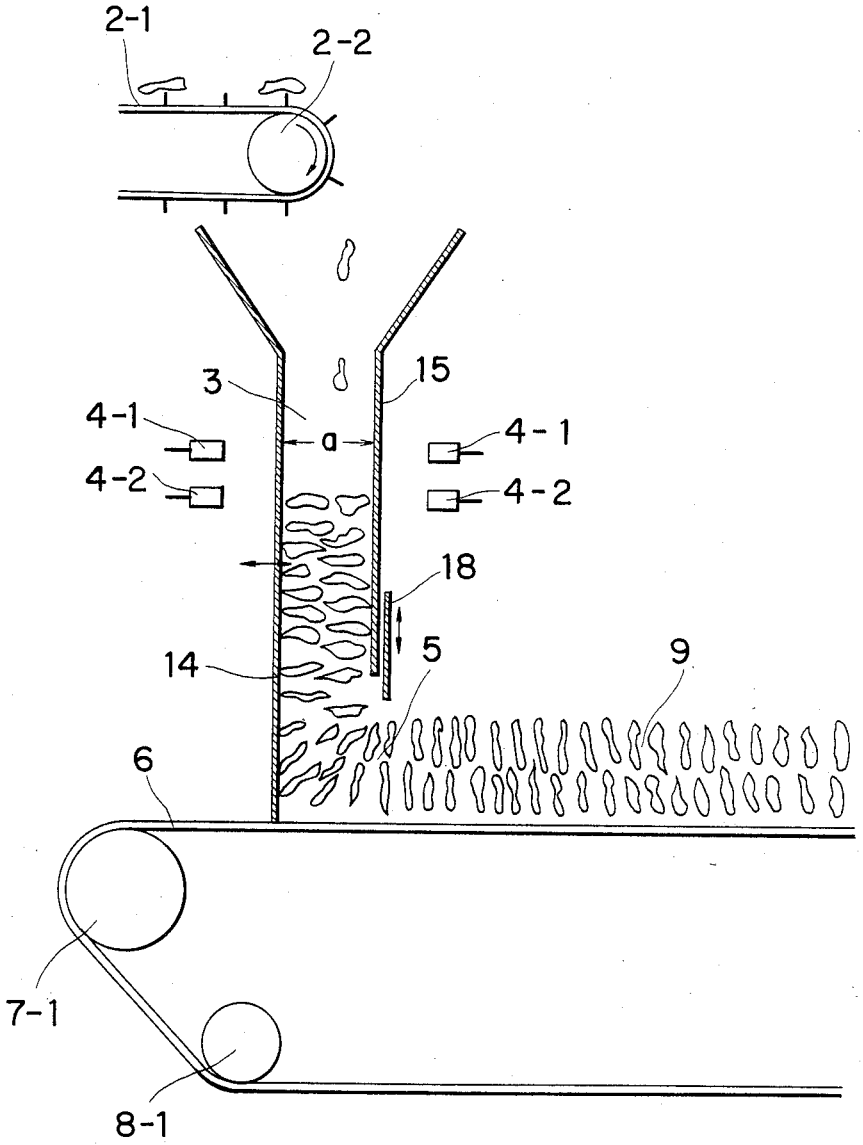
FIG. 3 is a longitudinal sectional view showing a hopper section.

The rate of supply of tobacco leaves varies depending on the kind of tobacco leaves, moisture content, size of tobacco leaves, height of the stack in the hopper section 3, etc. The rate of supply can be controlled by adjusting the width a of the guide portion of the hopper section 3 as shown in FIG. 3 by manually moving the first wall 14 forwards or backwards. At the time when the width a of the guide portion of the hopper section 3 is adjusted, jamming of tobacco leaves at the outlet 5 of the hopper section 3 is liable to result. To avoid this, the height of the outlet 5 is desirably set to a value greater than the width a of the guide portion of the hopper section 3 by 5 to 15 cm by vertically displacing the height adjustment member 18.

Since the tobacco leaves conveyed on the air-permeable conveyor 6 for drying are orientated parallel to the flow of air supply, the drying air can pass through the layer 9 of tobacco leaves uniformly compared to the prior art techniques. That is, the effective area of tobacco leaves exposed to drying air is increased, so it is possible to reduce fluctuations of drying and increase the drying efficiency. The installation space of the apparatus for air drying tobacco leaves thus can be reduced.

Figure 4:
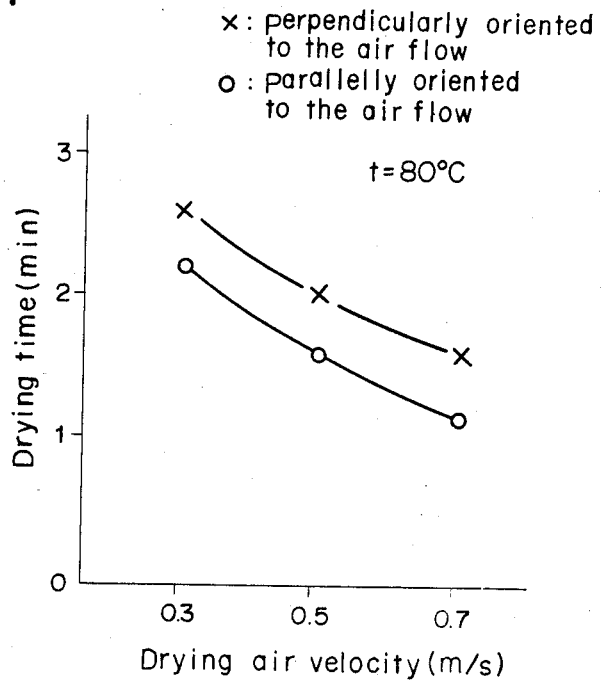
FIG. 4 is a graph showing the relationship among the orientation of tobacco leaves, drying time and rate of air supply.

FIG. 4 shows the drying time required to reduce the moisture content of tobacco leaves from 20% to 10% using apparatus for air drying tobacco leaves. The drying time is plotted against the rate of supply of drying air for the case where tobacco leaves are conveyed in an orientation perpendicular to the flow of air supply and the case where tobacco leaves are conveyed in an orientation parallel to the flow of air supply. In the case where the orientation of tobacco leaves is parallel to the flow of air supply, the drying time is shorter by about 20% than in the case of the perpendicular orientation. Obviously, the drying efficiency is superior in the case of the parallel orientation.

Figure 5:
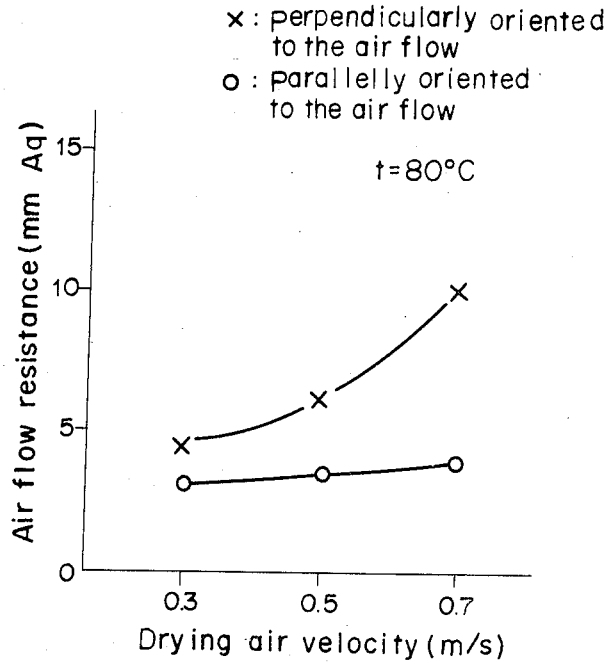
FIG. 5 is a graph showing the relationship among the orientation of tobacco leaves, resistance offered to air flow and rate of air supply.

FIG. 5 shows the air flow resistance offered to air passing through the air-permeable conveyor 6 and layer 9 of tobacco leaves using the apparatus for air drying tobacco leaves. The resistance is again plotted against the rate of supply of drying air for the case where tobacco leaves are conveyed in a perpendicular orientation and the case where they are conveyed in a parallel orientation with respect to the flow of air supply. In the case of the parallel orientation, the resistance is less than the case of the perpendicular orientation, so that it is possible to reduce power consumed by the motor for driving the air circulation fans 11-1 to 11-5 and also reduce the capacity (i.e., air pressure) of the drying air circulation fans.

Further, with the layer of tobacco leaves parallel to the flow of air supply, the layer of tobacco leaves is exposed to the supplied drying air more uniformly, so that the scattering of tobacco leaves by the drying air supplied from above or below the air-permeable conveyor 6 can be reduced.

What is claimed is:

1. An apparatus for air drying tobacco leaves comprising:

a tobacco leaf supply conveyor having a discharge end;

a vertical hopper disposed beneath said discharge end;

an air-permeable conveyor extending substantially from beneath said vertical hopper and running horizontally in a predetermined direction, said air-permeable conveyor being subjected to vertical air flows;

a guide section provided between said vertical hopper and said air permeable conveyor, said guide section including a first pair of vertical walls extending transversely with respect to the air-permeable conveyor and a second pair of vertical walls extending parallelly with the air-permeable conveyor to define a vertical chamber receiving tobacco leaves from the vertical hopper, said first pair of walls including a first wall positioned upstream of said vertical chamber and extending substantially down to the air-permeable conveyor and a second wall positioned downstream of said vertical chamber and spaced apart from the air-permeable conveyor to form an outlet portion; and a drying chamber provided to cover said air-permeable conveyor at an intermediate portion thereof.

2. An apparatus for air drying tobacco leaves according to claim 1, wherein said second pair of walls includes third and fourth walls extending substantially down to the air-permeable conveyor.

3. An apparatus for air drying tobacco leaves according to claim 2, wherein the first wall is slidable relatively to the second wall in a space between said third wall and fourth wall.

4. An apparatus for air drying tobacco leaves according to claim 2, wherein the second wall is slidable relatively to the first wall in a space between said third wall and fourth wall.

5. An apparatus for air drying tobacco leaves according to claim 1, wherein the second wall has an adjustment member provided for vertical movement on a lower portion of the second wall to adjust the height dimension of the outlet.

6. An apparatus for air drying tobacco leaves according to claim 1, wherein said first and second walls have respectively transparent members fitted in their central portions.

* * * * *